US012723330B1

(12) United States Patent
Jin

(10) Patent No.: US 12,723,330 B1
(45) Date of Patent: Sep. 1, 2026

(54) CHUNKY YARN FLUFFER TOOL

(71) Applicant: Jinhua Aurora Century Trading Co., Ltd., Jinhua (CN)

(72) Inventor: Yunqiu Jin, Jinhua (CN)

(73) Assignee: Jinhua Aurora Century Trading Co., Ltd., Jinhua (CN)

( * ) Notice: Subject to any disclaimer, the term of this patent is extended or adjusted under 35 U.S.C. 154(b) by 0 days.

(21) Appl. No.: 19/533,357

(22) Filed: Feb. 9, 2026

(51) Int. Cl.
*D02G 3/34* (2006.01)
*D02G 1/16* (2006.01)
*D04B 1/10* (2006.01)

(52) U.S. Cl.
CPC ..... *D02G 3/34* (2013.01); *D02G 1/161* (2013.01); *D04B 1/108* (2013.01)

(58) Field of Classification Search
CPC ..... D02G 3/34; D02G 1/161; D04B 1/108
See application file for complete search history.

(56) References Cited

U.S. PATENT DOCUMENTS 3,108,604 A * 10/1963 Krull ..... A45D 2/14 132/250
3,110,077 A * 11/1963 Spear ..... D04D 7/06 28/147
3,260,267 A * 7/1966 Rubenstein ..... A45D 2/146 132/245
5,261,428 A * 11/1993 Wu ..... A45D 8/12 132/282
9,301,586 B1 * 4/2016 Jones ..... A45D 8/26
2013/0186424 A1 * 7/2013 Zachery ..... A45D 8/34 132/275

* cited by examiner

*Primary Examiner* — Uyen T Nguyen

(57) ABSTRACT

A chunky yarn fluffer tool is provided for fluffing chunky yarn. The chunky yarn fluffer tool includes a first housing and a second housing. The first housing and the second housing are connectable to each other, and when connected together, a working chamber is defined and enclosed by the first housing and the second housing. The working chamber extends through the chunky yarn fluffer tool and has two openings at two opposite ends of the chunky yarn fluffer tool. Each of the first housing and the second housing comprises a plurality of comb teeth protruding from an inner wall of the working chamber towards a central axis of the working chamber.

14 Claims, 6 Drawing Sheets

CHUNKY YARN FLUFFER TOOL

FIELD OF THE DISCLOSURE

The present disclosure relates to a fluffing tool, and more particularly to a chunky yarn fluffer tool.

BACKGROUND

Blankets are typically made from ultra-thick chunky yarn woven from multiple fine threads. This chunky yarn is prone to compression or flattening during transportation and storage, meaning the fibers or threads on the surface of the yarn become compressed or flattened. Existing methods for fluffing the yarn mainly rely on patting, rubbing with the hands, or using a whisk, which may be cumbersome and inefficient.

SUMMARY

The following presents a simplified summary of the disclosure in order to provide a basic understanding of some aspects of the disclosure. This summary is not an extensive overview of the disclosure. It is not intended to identify critical elements or to delineate the scope of the disclosure. Its sole purpose is to present some concepts of the disclosure in a simplified form as a prelude to the more detailed description that is presented elsewhere.

In some embodiments, a chunky yarn fluffer tool is provided, the chunky yarn fluffer tool includes a first housing and a second housing. The first housing and the second housing are connectable to each other, and when connected together, a working chamber is defined and enclosed by the first housing and the second housing. The working chamber extends through the chunky yarn fluffer tool and has two openings at two opposite ends of the chunky yarn fluffer tool. Each of the first housing and the second housing comprises a plurality of comb teeth protruding from an inner wall of the working chamber towards a central axis of the working chamber.

In some embodiments, a chunky yarn fluffer tool is provided, the chunky yarn fluffer tool includes a first housing and a second housing. The first housing and the second housing are connected to each other to form a hollow cylinder which defines a working chamber having two openings at two opposite ends of the chunky yarn fluffer tool. Each of the first housing and the second housing includes a plurality of comb teeth protruding from an inner wall of the working chamber. Each of the comb teeth includes a connecting end and a contact end. The connecting end is connected to the inner wall of the working chamber. The contact end is positioned in proximity to a central axis of the working chamber.

BRIEF DESCRIPTION OF THE DRAWINGS

Illustrative embodiments of the present disclosure are described in detail below with reference to the attached drawing figures.

NUMERAL REFERENCE IN THE DRAWINGS

Figure 1:
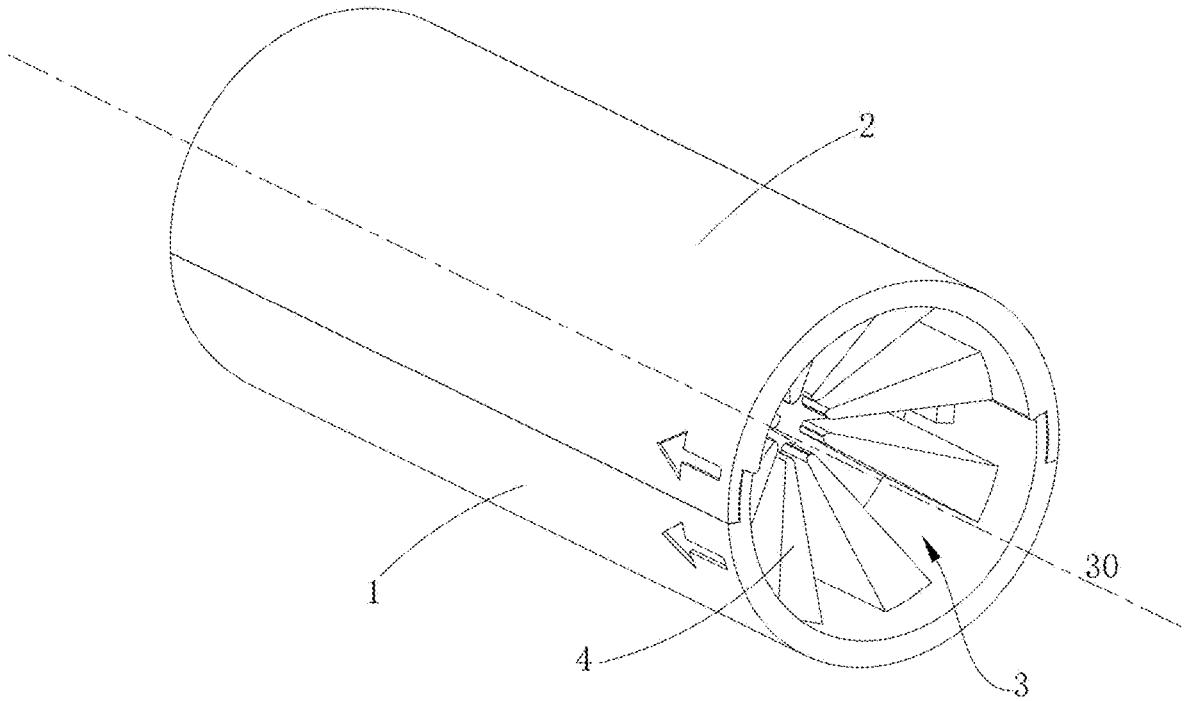
FIG. 1 is a schematic diagram of the overall structure of the chunky yarn fluffer tool in some embodiments.

1—First housing; 11—First connecting part; 110—First connecting edge; 111—groove; 112—Outer accommodating recess;

2—Second housing; 21—Second connecting part; 210—Second connecting edge; 211—protruded block; 212—Inner accommodating recess;

3—working chamber; 30—Central axis; 31—First end; 32—Second end;

4—Comb teeth; 40—Connecting end; 41—Contact end; 44—first inclined surface; 45—second inclined surface;

5—Combing layer;

R1—Inclination angle of the first inclined surface; R2—Inclination angle of the second inclined surface.

DETAILED DESCRIPTION

The following describes some non-limiting exemplary embodiments of the disclosure with reference to the accompanying drawings. The described embodiments are merely a part rather than all of the embodiments of the disclosure. All other embodiments obtained by a person of ordinary skill in the art based on the embodiments of the disclosure shall fall within the scope of the disclosure.

Unless otherwise defined, all technical and scientific terms used herein have the same meaning as commonly understood by those skilled in the art to which the present disclosure belongs. The terms used in the description of the present disclosure herein are intended for describing particular embodiments only and are not intended to limit the present disclosure. In the description, claims, and the above drawings of the present disclosure, the terms "including" and "having", as well as their variants, are intended to convey a non-exclusive inclusion. The terms "first", "second", etc., as used herein, are intended to distinguish between different objects, rather than to describe a particular order.

Reference to "embodiments" herein implies that a particular feature, structure, or characteristic described in conjunction with an embodiment may be included in at least one embodiment of the present disclosure. The appearance of the phrase at various places in the specification does not necessarily refer to the same embodiment, nor is it a separate or an alternative embodiment that is mutually exclusive of other embodiments. One skilled in the art would explicitly and implicitly understand that the embodiments described herein can be combined with other embodiments.

Referring to FIGS. 1-6, in some embodiments, a chunky yarn fluffer tool includes a first housing 1 and a second housing 2. The first housing 1 and the second housing 2 are connectable to each other, and when connected, they enclose a working chamber 3 with openings at both ends. Both the first housing 1 and the second housing 2 have multiple comb teeth 4 protruding from the inner wall of the working chamber 3.

The chunky yarn fluffer tool is mainly used for fluffing ultra-thick chunky yarn. Ultra-thick chunky yarn is typically a long, strip-shaped fibrous material used in the textile or filling industry. Due to its length and continuous strip-like distribution, it is easily compressed, flattened, or even crushed during transportation, storage, or stacking, resulting in reduced fluffiness of the yarn surface and affecting subsequent use. Ultra-thick chunky yarn can also be referred to as strip-shaped chunky yarn fabric/strip-shaped chunky yarn fleece, and will be uniformly referred to as ultra-thick chunky yarn hereinafter. The chunky yarn fluffer tool includes a first housing 1 and a second housing 2, which are separable. In the separated state, both the first housing 1 and the second housing 2 have an open inner cavity structure on one side, and multiple comb teeth 4 protrude from the inner wall of the working chamber 3. The comb teeth 4 can be integrally molded with the housing body, preferably made of plastic material, which can effectively comb the ultra-thick chunky yarn during use without easily damaging the fibers. Since the first housing 1 and the second housing 2 are separate structures, the operator does not need to thread the extra-thick yarn through the tool from its end. Instead, the operator can directly fluff the yarn from any point along its length as needed, which is especially suitable for scenarios where only a quick fluffing of a local area is required. The working chamber 3 is specifically designed with openings at both ends, allowing the extra-thick yarn within the working chamber 3 to be pulled from one end to the other and come into contact with the multiple comb teeth 4 inside the working chamber 3. The working chamber 3 can be a straight, through-chamber with openings at both ends, or a curved, interconnected chamber. In this embodiment, a straight, through-chamber with openings at both ends is used as an example for illustration.

In actual use, the operator can first place the extra-thick yarn along its length against the inner wall of the first housing 1 or the second housing 2, so that the extra-thick yarn is adjacent to the multiple comb teeth 4 on the inner wall of the corresponding housing. Then, the other housing is connected to this housing, so that the first housing 1 and the second housing 2 enclose to form the working chamber 3 with openings at both ends; at this time, the extra-thick yarn is placed inside the working chamber 3 and is in contact with the multiple comb teeth 4 on the wall of the working chamber 3. The operator can hold the chunky yarn fluffer tool with one hand and pull the extra-thick yarn along its length with the other hand, causing the extra-thick yarn to move relative to the multiple comb teeth 4 within the working chamber 3. Because the comb teeth 4 are distributed along the chamber wall, as the extra-thick yarn is pulled, its surface fibers will come into contact with the multiple comb teeth 4, thereby achieving gradual loosening and fluffing of the yarn. The arrangement of multiple comb teeth 4 effectively increases the contact area with the extra-thick yarn, making the combing process more thorough and uniform. This chunky yarn fluffer tool utilizes a working chamber 3 formed by the separation of the first housing 1 and the second housing 2 to provide stable wrapping and guidance for the extra-thick yarn. With the help of multiple comb teeth 4 arranged on the inner wall of the working chamber 3, it achieves multi-point contact combing of the extra-thick yarn. Compared to methods that only involve rubbing with the palm or using non-specialized tools such as egg beaters, this chunky yarn fluffer tool can quickly and continuously act on various parts of the extra-thick yarn during the pulling process, allowing the yarn to recover its fluffy state faster, and the fluffiness is more even and thorough, thus improving fluffing efficiency and effect.

Figure 2:
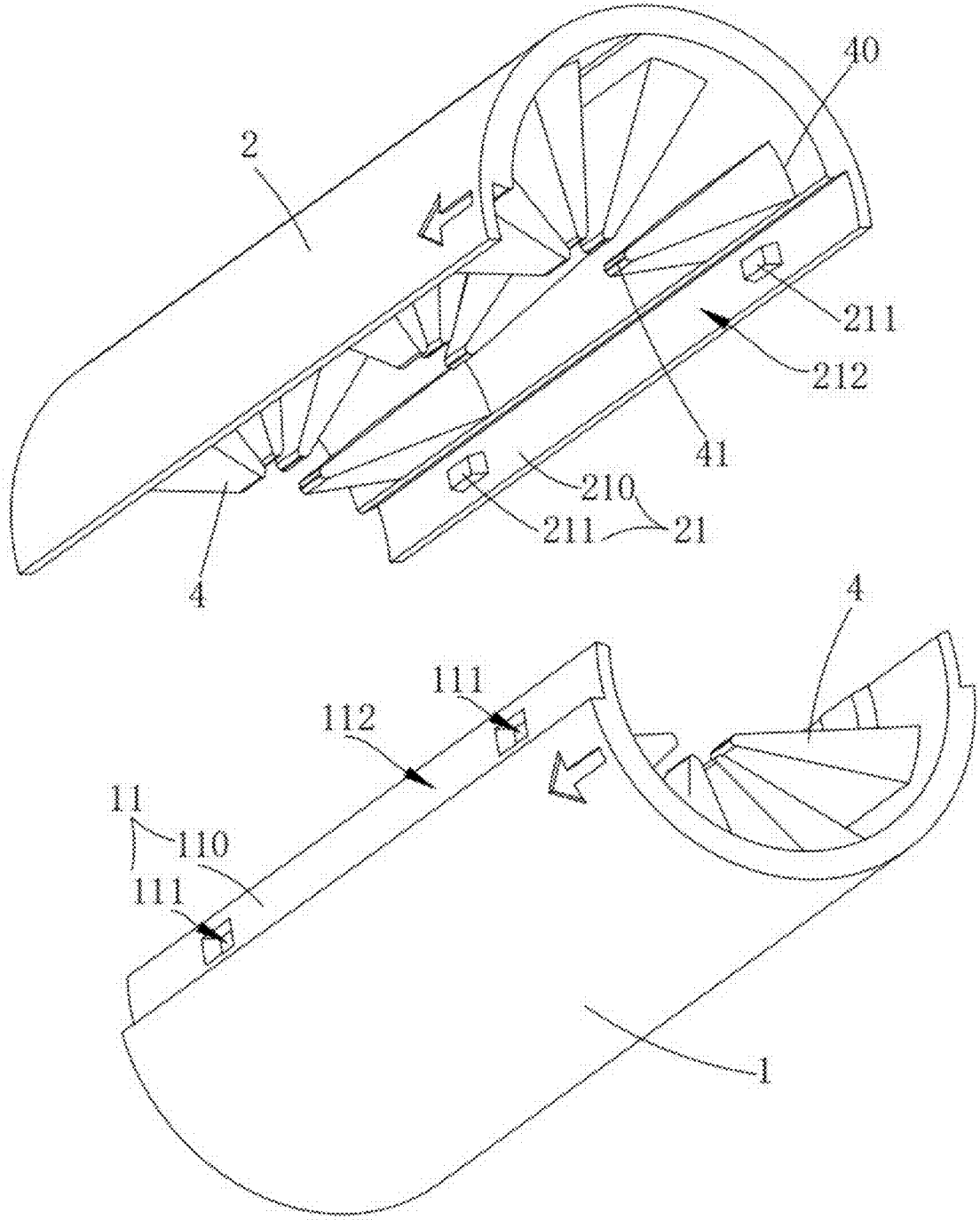
FIG. 2 is an exploded view of the structure of the chunky yarn fluffer tool in some embodiments.

Referring to FIGS. 1 and 2, in some embodiments, the working chamber 3 is open at both ends; after the first housing 1 and the second housing 2 are connected together, the chunky yarn fluffer tool has an overall hollow cylinder shape, and the working chamber 3 is a cylindrical cavity extending along a length direction of the chunky yarn fluffer tool.

Specifically, the first housing 1 and the second housing 2 are preferably both semi-cylindrical shell structures, and when connected, they enclose to form an overall cylindrical outer contour. The cylindrical outer contour conforms to the natural grip shape of the human hand, allowing users to obtain a relatively stable and comfortable grip when operating the chunky yarn fluffer tool with one hand. This helps maintain the stability of the tool's posture during the process of pulling the extra-thick yarn and reduces operational fatigue. Correspondingly, the working chamber 3 formed by the first housing 1 and the second housing 2 in this embodiment is a cylindrical cavity. A central axis 30 of this cylindrical working chamber 3 is substantially consistent with the axis of the overall shape of the chunky yarn fluffer tool, so that the multiple comb teeth 4 arranged on the inner wall of the working chamber 3 can be evenly distributed circumferentially. When the extra-thick yarn is pulled inside the working chamber 3, its outer circumference can come into contact with multiple comb teeth 4 in all directions, thereby achieving full-circumferential, multi-directional combing of the extra-thick yarn, which helps to separate and loosen the yarn fibers in all directions, improving the uniformity of fluffing. In other embodiments, the overall outer contour of the chunky yarn fluffer tool is not limited to a cylindrical shape, but can also be a square column, hexagonal column, or other polygonal column structure; correspondingly, the working chamber 3 can also be set as a square column, hexagonal column, or polygonal cavity. In the above different embodiments, the multiple comb teeth 4 can still be distributed along the inner wall of the working chamber 3 and provide multi-directional contact and combing action on the extra-thick chunky yarn, thus effectively fluffing the extra-thick chunky yarn.

Figure 3:
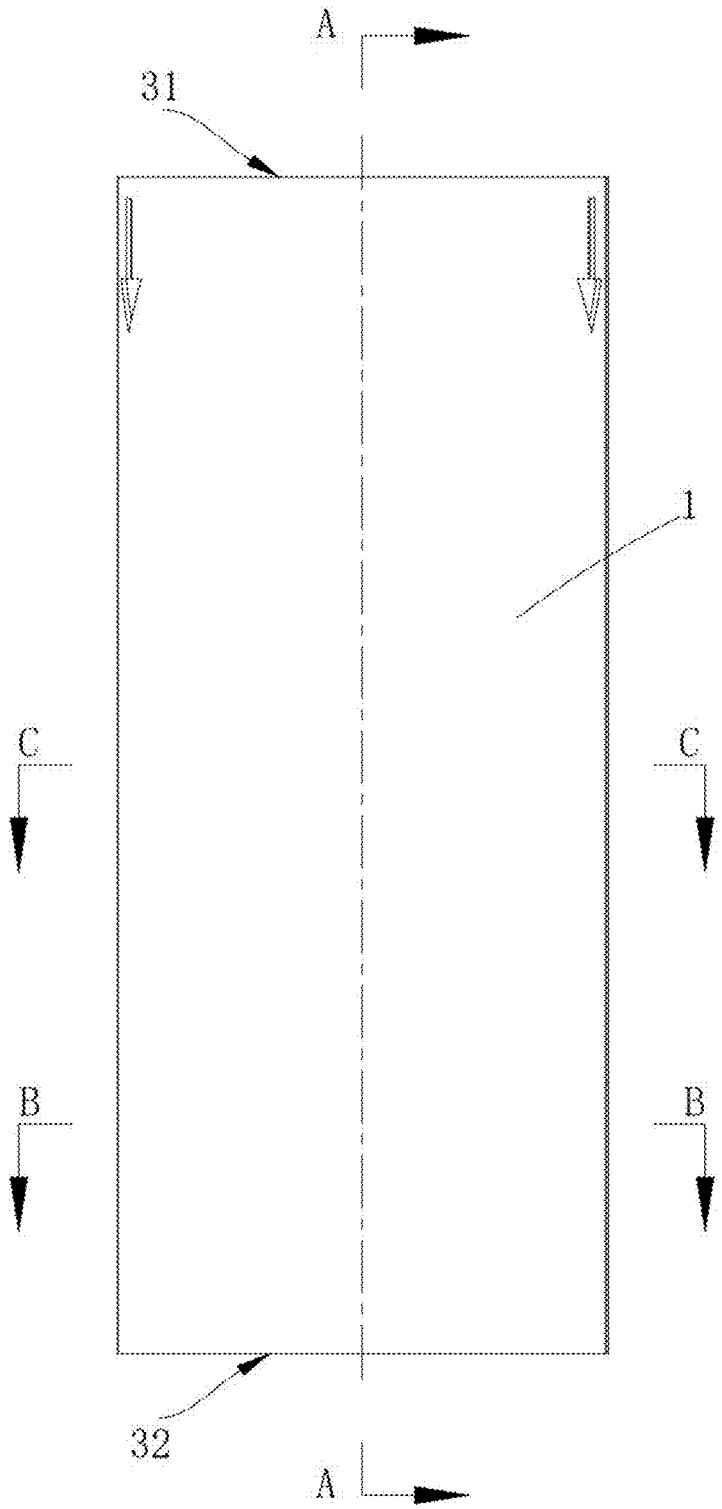
FIG. 3 is an orthographic projection view of the chunky yarn fluffer tool in some embodiments.

Referring to FIGS. 1-3, in some embodiments, the working chamber 3 has a central axis 30 extending along its length direction, the central axis 30 passing through the center of the working chamber 3, and the multiple comb teeth 4 are arranged to extend towards the central axis 30.

Specifically, when the working chamber 3 is a cylindrical cavity, the central axis 30 is specifically the central axis of the cylindrical working chamber 3, which extends along the length direction of the working chamber 3 and is located at the geometric center of the working chamber 3. Based on this structure, the multiple comb teeth 4 arranged on the cavity wall of the working chamber 3 all extend radially towards the central axis, that is, the extension direction of each comb tooth 4 basically points to the central region of the cylindrical working chamber 3. By setting the comb teeth 4 to extend radially towards the central axis 30, when the extra-thick chunky yarn is located inside the working chamber 3 and pulled along the length direction, the yarn fibers in different directions on its outer circumference can simultaneously or sequentially come into contact with the comb teeth 4 located at different circumferential positions. Compared with the method of setting the combing structure only in a single direction or a local area, this radially distributed comb tooth 4 structure allows the extra-thick chunky yarn to continuously receive pulling and dispersing effects from multiple circumferential directions during its passage through the working chamber 3, thereby improving the uniformity of combing.

Figure 4:
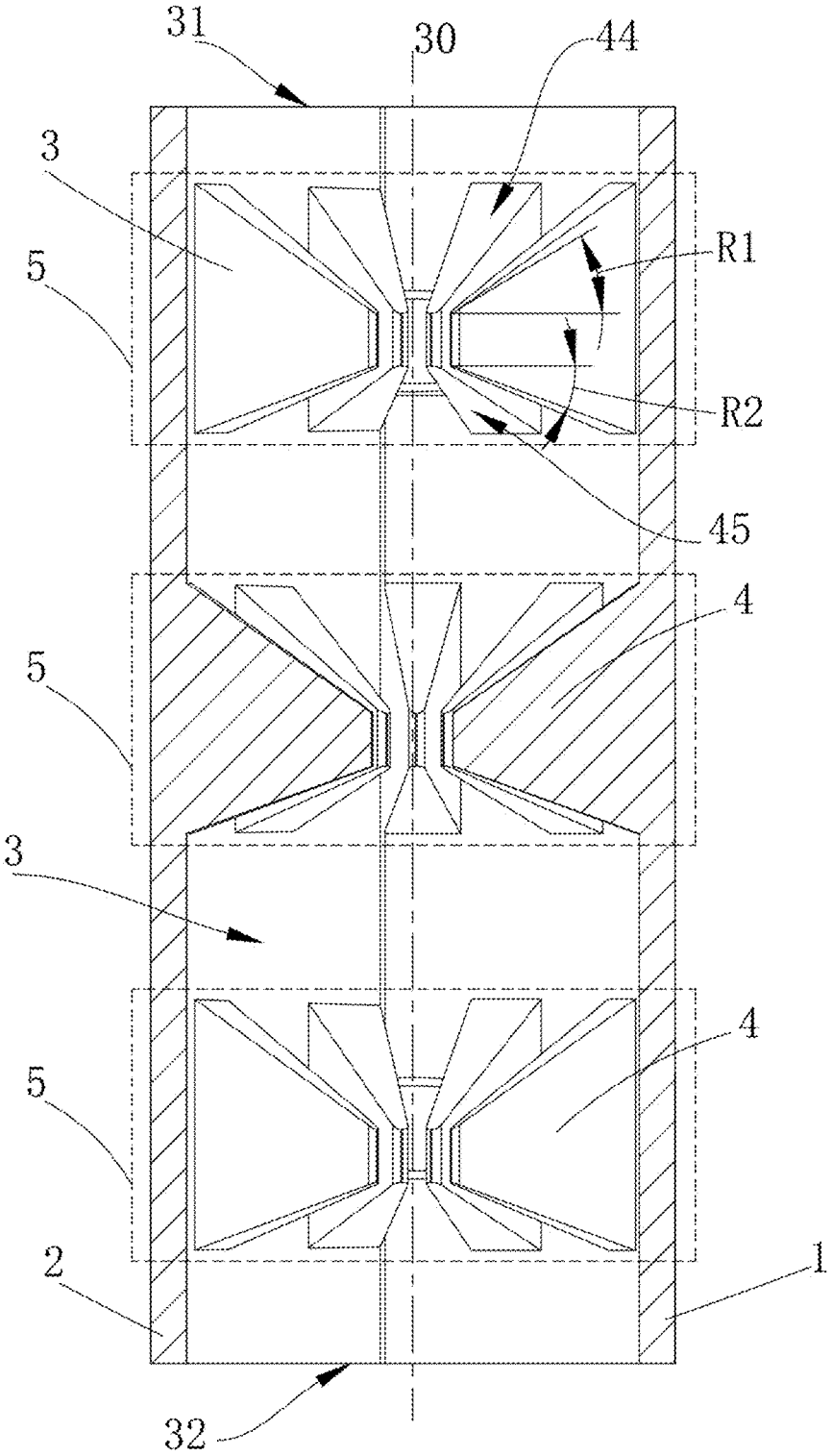
FIG. 4 is a cross-sectional view along A-A in FIG. 3.
Figure 5:
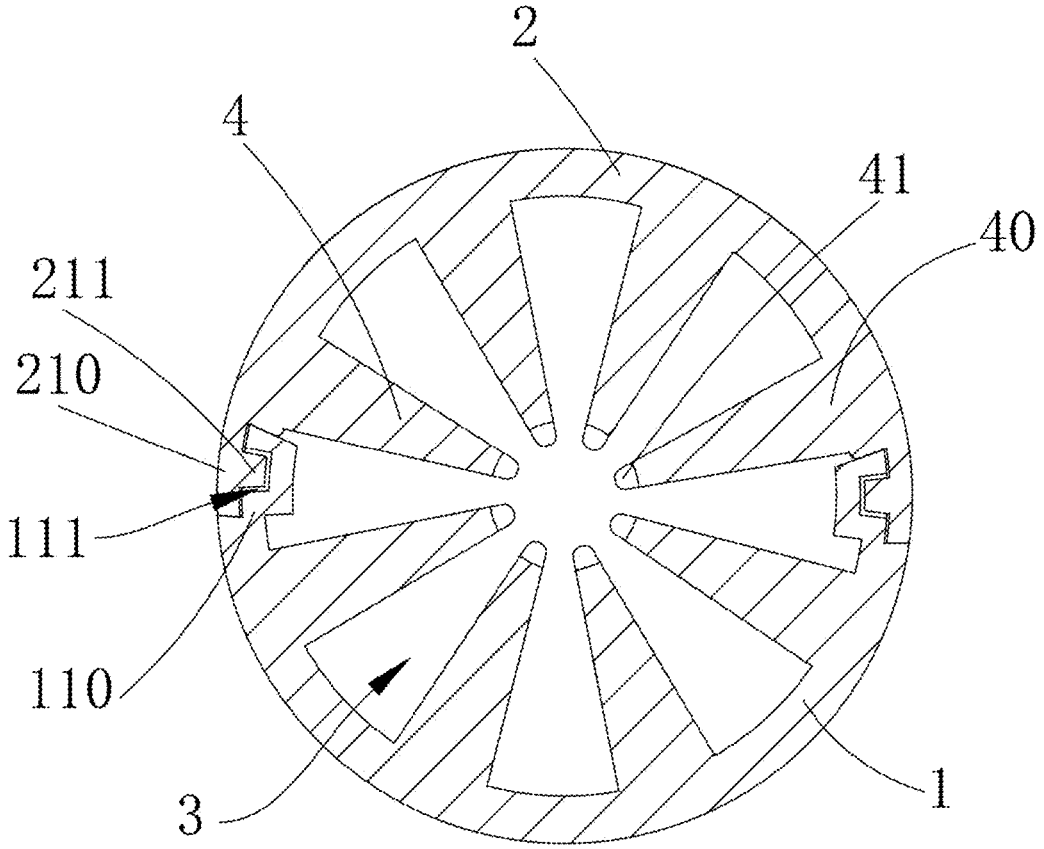
FIG. 5 is a cross-sectional view along B-B in FIG. 3.

Referring to FIGS. 3-6, in some embodiments, the projected contours of the multiple comb teeth 4 on the first projection plane are spaced apart from each other, where the first projection plane is a plane perpendicular to the central axis 30. Specifically, the first projection plane is a plane perpendicular to the central axis 30 of the working chamber 3. When viewed on this first projection plane, multiple comb teeth 4 located at the same position in the length direction of the working chamber 3 are spaced apart in the circumferential direction of the working chamber 3. In some embodiments, the multiple comb teeth 4 are distributed in an equidistant array along the circumferential direction, so that a relatively uniform spacing is formed between adjacent comb teeth 4 (as shown in FIG. 5). A number of comb teeth 4 located at the same layer in the length direction of the working chamber 3 may be 8. This ensures uniform distribution of the comb teeth 4 while preventing the spacing between adjacent comb teeth 4 from becoming too large, thus avoiding insufficient combing caused by the extra-thick yarn only contacting the comb teeth 4 in a local area when passing through the working chamber 3. The equidistantly arranged multiple comb teeth 4 allow the extra-thick yarn to sequentially contact each comb tooth 4 at different circumferential positions, improving the coverage of the combing process. In some embodiments, the number of comb teeth 4 mentioned above is only a preferred example; the number of comb teeth 4 at the same layer of height may be varied according to actual needs without affecting the normal passage and fluffing effect of the extra-thick yarn.

Referring to FIGS. 3-6, in some embodiments, the multiple comb teeth 4 form multiple combing layers 5, and the multiple combing layers 5 are spaced apart along the length direction of the working chamber 3.

Specifically, the multiple comb teeth 4 can not only form a single combing structure at the same height or layer in the length direction of the working chamber 3, but can also be arranged as multiple combing layers 5 along the length direction of the working chamber 3. Each combing layer 5 is composed of multiple comb teeth 4, and each combing layer 5 is spaced apart from each other in the length direction of the working chamber 3, thus forming a multi-stage combing structure arranged sequentially along the axial direction inside the working chamber 3. During use, when the extra-thick yarn is pulled along the length direction of the working chamber 3, it will sequentially pass through multiple combing layers 5 distributed along the length direction. Since each combing layer 5 contains multiple comb teeth 4, when the extra-thick yarn passes through each combing layer 5, it will contact and be acted upon by the multiple comb teeth 4 in that layer, further separating and lifting the already partially loosened yarn fibers. The continuous arrangement of multiple combing layers 5 allows the ultra-thick chunky yarn to undergo a multi-stage combing process within the working chamber 3, rather than being combed at a single location. This increases the total number of contacts and the length of the interaction path between the comb teeth 4 and the ultra-thick chunky yarn, resulting in more thorough and gradual loosening and fluffing of the yarn fibers.

Referring to FIGS. 3-6, in some embodiments, the projected contours of adjacent combing layers 5 on the first projection plane do not overlap; or, the projected contours of adjacent combing layers 5 on the first projection plane at least partially do not overlap; where the first projection plane is a plane perpendicular to the central axis 30.

Figure 6:
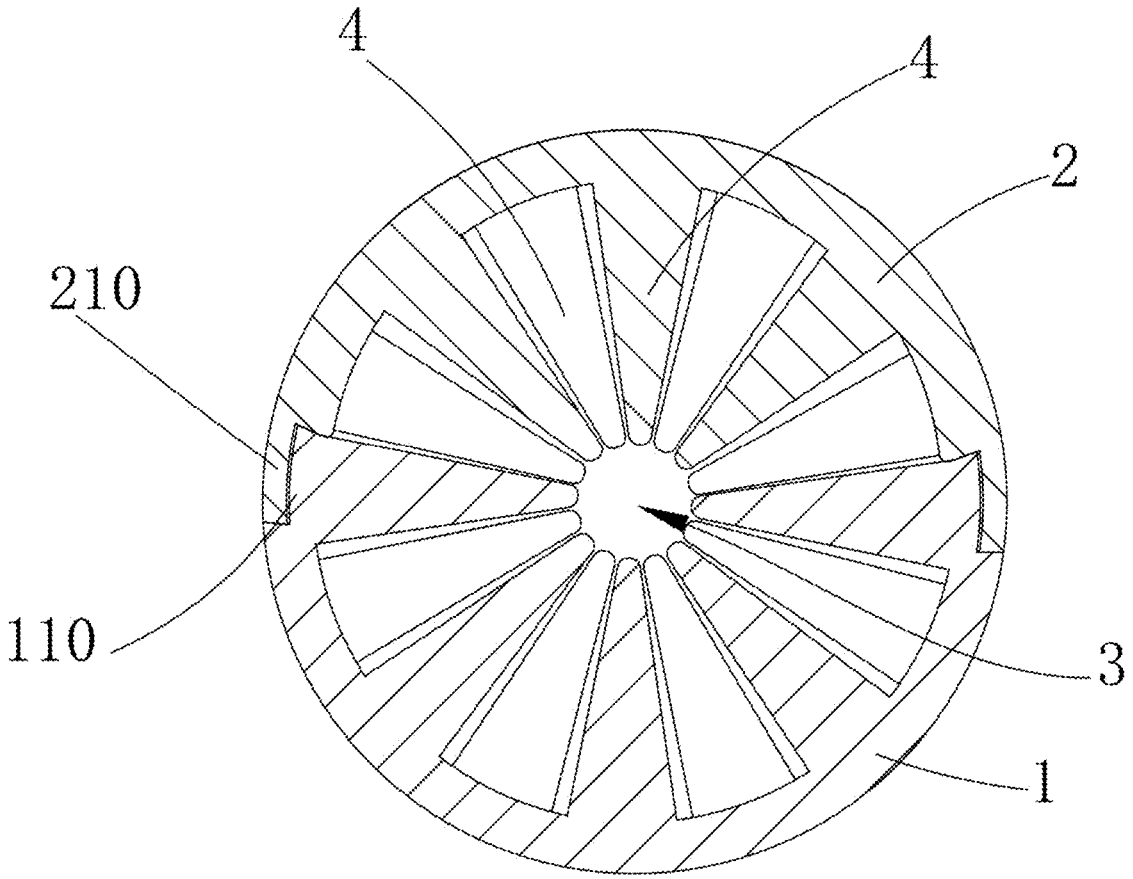
FIG. 6 is a cross-sectional view along C-C in FIG. 3.

Specifically, the projected contours of adjacent combing layers 5 on the first projection plane are arranged in an offset manner, meaning that the multiple comb teeth 4 in adjacent combing layers 5 do not completely overlap on the first projection plane perpendicular to the central axis 30. Specifically, in one embodiment, the projected contours of adjacent combing layers 5 on the first projection plane may not overlap at all (as shown in FIG. 6); in another embodiment, the projected contours of adjacent combing layers 5 may overlap only in some areas and not in others. By offsetting the comb teeth 4 of adjacent combing layers 5, the distribution positions of the comb teeth 4 in the circumferential direction of the combing layers 5 at different height are different from each other. When the ultra-thick chunky yarn passes through each combing layer 5 in sequence along the through-direction of the working chamber 3, the circumferential areas that have not been fully contacted by the comb teeth 4 in the previous combing layer 5 can come into contact with the comb teeth 4 at different circumferential positions in the subsequent combing layers 5. This prevents the ultra-thick chunky yarn from always interacting with the comb teeth 4 along the same circumferential path during the multi-layer combing process, ensuring that different circumferential positions of the ultra-thick chunky yarn are successively contacted by multiple comb teeth 4 in different combing layers 5 as it is pulled along the through-direction of the working chamber 3, resulting in more comprehensive combing coverage of the circumferential range of the ultra-thick chunky yarn.

Referring to FIGS. 2 and 4, in some embodiments, the comb teeth 4 include a connecting end 40 and a contact end 41. The connecting end 40 is connected to the inner wall of the working chamber 3, and the contact end 41 is positioned near the central axis 30, with the contact ends 41 of multiple comb teeth 4 being close to each other.

Specifically, each comb tooth 4 includes a connecting end 40 extending from the inner wall of the working chamber 3, and a contact end 41 located away from the inner wall of the working chamber 3, used to interact with the extra-thick yarn. The connecting end 40 can be integrally formed with the first housing 1 or the second housing 2, thus ensuring the structural stability of the comb teeth 4 during use; the contact end 41 extends towards the central axis 30 of the working chamber 3, used to agitate and separate the extra-thick yarn entering the working chamber 3. As shown in FIG. 4, the contact ends 41 of multiple comb teeth 4 are close to each other but do not touch each other, thus forming a gap between adjacent contact ends 41 through which the extra-thick yarn can pass smoothly. On the one hand, the setting of this gap prevents the contact ends 41 from completely closing and obstructing the passage of the extra-thick yarn, ensuring that the extra-thick yarn can pass through the working chamber 3 continuously and smoothly during the pulling process; on the other hand, the distance between the multiple contact ends 41 is not too large, so that the contact ends 41 can still effectively agitate and lift the yarn fibers on the surface of the extra-thick yarn as it passes through, thereby achieving the combing and loosening of the yarn.

Referring to FIGS. 2 and 4, in some embodiments, the comb teeth 4 include a connecting end 40 and a contact end 41. The connecting end 40 is connected to the inner wall of the working chamber 3, the contact end 41 is positioned near the central axis 30, and the cross-sectional area of the comb teeth 4 gradually decreases from the connecting end 40 to the contact end 41.

Specifically, the cross-sectional area of the connecting end 40 is relatively large, giving the comb teeth 4 high structural strength and stability when connected to the first housing 1 or the second housing 2, so that they are not easily bent or deformed during repeated use and contact with the extra-thick yarn. The comb teeth 4 gradually narrow from the connecting end 40 towards the central axis 30, with the contact end 41 having a relatively small cross-sectional area, giving the comb teeth 4 an overall spike-like or conical structure. In this structure, the projection profile of a single comb tooth 4 on the first projection plane is roughly triangular, with the wider side corresponding to the connecting end 40 and the narrower side corresponding to the contact end 41. By setting the contact end 41 to have a smaller cross-sectional area, the contact end 41 can more easily penetrate between the fibers of the extra-thick chunky yarn, providing a combing and separating effect without causing large-area compression or blockage of the yarn. The gradually decreasing cross-sectional area may also provide a certain degree of flexibility to the comb teeth 4 near the contact end 41, making them more adaptable to the shape changes of the extra-thick chunky yarn.

Referring to FIGS. 3 and 4, in some embodiments, the working chamber 3 has a first end 31 and a second end 32 that are spaced apart in its length direction. Each comb tooth 4 includes a first inclined surface 44 and a second inclined surface 45 that are oppositely arranged. The first inclined surface 44 faces the first end 31 and extends inclinedly from the inner wall of the working chamber 3 towards the second end 32, and the second inclined surface 45 faces the second end 32 and extends inclinedly from the inner wall of the working chamber towards the first end 31.

The first end 31 and the second end 32 of the working chamber 3 are spaced apart from each other along the length direction of the working chamber 3, so as to correspond to different pulling directions that the extra-thick chunky yarn may experience during use. The first inclined surface 44 and the second inclined surface 45 are arranged opposite to each other along the length direction of the working chamber 3, with the first inclined surface 44 facing the first end 31 and the second inclined surface 45 facing the second end 32. Both the first inclined surface 44 and the second inclined surface 45 extend inclinedly from the inner wall of the working chamber 3 toward the central axis 30, thereby providing the comb teeth 4 with a bidirectional gradient structure within the working chamber 3. In a configuration in which the comb teeth 4 do not form a bevel at the contact end 41 but instead have a flat or substantially perpendicular end surface, the comb teeth 4 tend to directly obstruct the extra-thick chunky yarn when the yarn is pulled within the working chamber 3, thereby making effective combing and separation difficult to achieve. By contrast, by providing the first inclined surface 44 and the second inclined surface 45 on the comb teeth 4, the extra-thick chunky yarn can be gradually lifted and separated along the inclined surfaces when coming into contact with the comb teeth 4, thereby facilitating loosening of the yarn fibers. The inclined arrangement of the first inclined surface 44 and the second inclined surface 45 further facilitates pulling of the extra-thick chunky yarn within the working chamber 3.

Referring to FIGS. 3 and 4, in some embodiments, the inclination angle of the first inclined surface 44 is the same as the inclination angle of the second inclined surface 45; or, the inclination angle of the first inclined surface 44 is greater than the inclination angle of the second inclined surface 45.

In one embodiment, the inclination angle of the first inclined surface 44 and the inclination angle of the second inclined surface 45 are set to be the same, so that the comb teeth 4 have basically consistent guiding characteristics in the direction of the first end 31 and the second end 32 of the working chamber 3, thus achieving a relatively balanced fluffing effect when the extra-thick chunky yarn is pulled from either direction. In another preferred embodiment, the inclination angle of the first inclined surface 44 is set to be greater than the inclination angle of the second inclined surface 45. The first inclined surface 44 corresponds to the direction in which the extra-thick chunky yarn is pulled from the first end 31 to the second end 32. The larger inclination angle can produce a more significant lifting and separating effect on the yarn fibers during the pulling process, making the fluffing effect of the extra-thick chunky yarn more pronounced in this direction; while when the extra-thick chunky yarn is pulled from the second end 32 to the first end 31, due to the relatively smaller inclination angle of the second inclined surface 45, its combing effect on the yarn is relatively gentle, and the resulting fluffing effect is relatively less pronounced, but it can still achieve basic combing and loosening functions; providing users with more flexible usage options, which is conducive to meeting different fluffing degree requirements, and further improving the controllability of the fluffing effect. Referring to FIGS. 2, 3, 5, and 6, in some embodiments, the first housing 1 is provided with a first connecting portion 11, and the second housing 2 is provided with a second connecting portion 21, wherein the first connecting portion 11 and the second connecting portion 21 can be latched together.

Specifically, the first connecting portion 11 and the second connecting portion 21 are used to achieve a detachable connection between the first housing 1 and the second housing 2. The latching structure can take various forms. For example, the first connecting portion 11 may have a protruded block, and the second connecting portion 21 may have a groove that mates with the protruded block; or, the first connecting portion 11 and the second connecting portion 21 may respectively have mutually cooperating hooks, elastic tongues, limiting grooves, or other structural forms that can achieve elastic fastening. The latching structure can be reasonably selected according to the material characteristics and processing technology. By using a latching method, the first housing 1 and the second housing 2 can be quickly fastened together to form the working chamber 3 during use, and can be quickly separated by applying external force when it is necessary to replace, place, or remove the extra-thick chunky yam; compared with threaded connections or screw fixing methods, this latching structure does not require additional tools, making the operation process simpler.

Referring to FIGS. 2, 3, 5, and 6, in some embodiments, the first connecting portion 11 includes two first connecting edges 110, the two first connecting edges 110 are symmetrically arranged on both sides of the first housing 1 and extend along the length direction of the working chamber 3; the second connecting portion 21 includes two second connecting edges 210, the two second connecting edges 210 are symmetrically arranged on both sides of the second housing 2 and extend along the length direction of the working chamber 3; one of the first connecting edge 110 and the second connecting edge 210 is provided with at least one groove 111, and the other is provided with at least one protruded block 211 that mates with the groove 111. Both the first housing 1 and the second housing 2 may be semi-cylindrical shell structures. The two first connecting edges 110 of the first housing 1 are respectively located at its opposite side edges. The first connecting edges 110 protrude circumferentially from the side edges of the first housing 1 and extend along the axial direction 30, thus forming continuous connecting edge structures on both sides of the first housing 1. Two grooves 111 are defined in each first connecting edge 110, and spaced apart from each other along the length direction of the first connecting edge 110. The two second connecting edges 210 of the second housing 2 are structured in the same way as the first housing 1, symmetrically located at the opposite side edges of the second housing 2, and extending along the axial direction of the second housing 2. The second connecting edges 210 are correspondingly provided with protruded blocks 211 that match with the grooves 111. The number, position, and spacing of the protruded blocks 211 correspond one-to-one with the grooves 111. When the first housing 1 and the second housing 2 are connected together and assembled, the first connecting edges 110 and the second connecting edges 210 align and fit together in the circumferential direction. The protruded blocks 211 elastically enter the corresponding grooves 111 during assembly, thereby achieving a stable connection. By setting the two first connecting edges 110 and the two second connecting edges 210 as symmetrical structures extending in the length direction, the alignment accuracy when connecting the first housing 1 and the second housing 2 is improved, and the connection force is distributed more evenly along the axial direction, effectively enhancing the overall connection stability and reliability. This structure ensures a secure snap-fit connection while still allowing for quick disassembly with external force when needed, balancing stability and detachability, which is beneficial for improving the durability and ease of use of the fluffer tool in practical applications. Referring to FIGS. 2, 3, 5, and 6, in some embodiments, when the first housing 1 and the second housing 2 are connected to each other to form a working chamber 3, the connection between the first housing 1 and the second housing 2 is smooth and has no protrusion on the outer surface of the cylindrical chunky yarn fluffer tool.

When the first housing 1 and the second housing 2 enclose to form the working chamber 3, the first connecting edge 110 and the second connecting edge 210 are stacked in the radial direction. The first connecting edge 110 is located on the side closer to the working chamber 3, and the second connecting edge 210 is located on the side further away from the working chamber 3. The outer wall of the first housing 1 forms an outer receiving recess 112 for accommodating the second connecting edge 210. The inner wall of the second housing 2 forms an inner receiving recess 212 for accommodating the first connecting edge 110. After the first housing 1 and the second housing 2 are connected, the second connecting edge 210 is embedded in the outer receiving recess 112 and does not protrude from the outer wall surface of the first housing 1. Therefore, after the first housing 1 and the second housing 2 are connected, the connection point on the outer surface away from the working chamber 3 is smooth and has no protrusion, thereby improving the user's grip and enhancing operating comfort.

Many different arrangements of the various components depicted, as well as components not shown, are possible without departing from the spirit and scope of the present disclosure. Embodiments of the present disclosure have been described with the intent to be illustrative rather than restrictive. Alternative embodiments will become apparent to those skilled in the art that do not depart from its scope. A skilled artisan may develop alternative means of implementing the aforementioned improvements without departing from the scope of the present disclosure.

It will be understood that certain features and subcombinations are of utility and may be employed without reference to other features and subcombinations and are contemplated within the scope of the claims.

What is claimed is:

1. A chunky yarn fluffer tool, comprising:

a first housing; and a second housing, wherein the first housing and the second housing are connectable to each other, and when connected together, a working chamber is defined and enclosed by the first housing and the second housing, the working chamber extending through the chunky yarn fluffer tool and having two openings at opposite ends of the chunky yarn fluffer tool, and wherein each of the first housing and the second housing comprises a plurality of comb teeth protruding from an inner wall of the working chamber towards a central axis of the working chamber;

wherein each of the plurality of comb teeth comprises a connecting end connected to the inner wall of the working chamber and a contact end positioned adjacent to the central axis of the working chamber;

wherein contact ends of the plurality of comb teeth are spaced apart from each other to define yarn-passing gaps configured to allow continuous passage of chunky yarn through the working chamber;

wherein the plurality of comb teeth form a plurality of combing layers spaced apart from each other along a length direction of the working chamber;

wherein projected contours of adjacent combing layers on a first projection plane perpendicular to the central axis at least partially do not overlap; the projected contours of adjacent combing layers on the first projection plane are arranged in an offset manner;

wherein each of the plurality of comb teeth comprises a first inclined surface and a second inclined surface arranged opposite to each other; each of the first inclined surface and the second inclined surface is flat;

wherein the plurality of comb teeth are configured to gradually separate and loosen surface fibers of the chunky yarn during relative movement of the chunky yarn through the working chamber.

2. The chunky yarn fluffer tool according to claim 1, wherein the central axis of the working chamber passes through a center of the working chamber and extends along a length direction of the chunky yarn fluffer tool.

3. The chunky yarn fluffer tool according to claim 2, wherein a cross-sectional area of each of the plurality of comb teeth gradually decreases from the connecting end toward the contact end.

4. The chunky yarn fluffer tool according to claim 2, wherein projections of the plurality of comb teeth on the first projection plane are spaced apart from each other.

5. The chunky yarn fluffer tool according to claim 2, wherein the working chamber has a first end and a second end that are spaced apart from each other along the length direction, wherein the first inclined surface faces toward the first end and extends inclinedly from the inner wall of the working chamber towards the second end, and the second inclined surface faces toward the second end and extends inclinedly from the inner wall of the working chamber towards the first end.

6. The chunky yarn fluffer tool according to claim 5, wherein an inclination angle of the first inclined surface is equal to an inclination angle of the second inclined surface; or the inclination angle of the first inclined surface is greater than the inclination angle of the second inclined surface.

7. The chunky yarn fluffer tool according to claim 1, wherein the first housing comprises a first connecting portion, the second housing comprises a second connecting portion, and the first connecting portion and the second connecting portion are configured to be snap-fitted to each other.

8. The chunky yarn fluffer tool according to claim 7, wherein the first connecting portion comprises two first connecting edges symmetrically disposed on opposite side edges of the first housing and extending along a length direction of the working chamber, wherein the second connecting portion comprises two second connecting edges symmetrically disposed on opposite side edges of the second housing and extending along the length direction of the working chamber, and wherein at least one of the first connecting edges comprises at least one groove, and at least one of the second connecting edges comprises at least one protruded block configured to engage with the at least one groove.

9. The chunky yarn fluffer tool according to claim 1, wherein when the first housing and the second housing are connected to define the working chamber, a connection region between the first housing and the second housing is smooth and has no protrusion on an outer surface of the chunky yarn fluffer tool.

10. The chunky yarn fluffer tool according to claim 2, wherein after the first housing and the second housing are connected, the chunky yarn fluffer tool has an overall cylindrical outer contour, and the working chamber is a cylindrical cavity extending along the length direction.

11. A chunky yarn fluffer tool, comprising:

a first housing; and a second housing, wherein the first housing and the second housing are connected to each other to form a hollow cylinder which defines a working chamber having two openings at two opposite ends of the chunky yarn fluffer tool, and wherein each of the first housing and the second housing comprises a plurality of comb teeth protruding from an inner wall of the working chamber, each of the plurality of comb teeth comprises a connecting end and a contact end, the connecting end is connected to the inner wall of the working chamber, the contact end is positioned in proximity to a central axis of the working chamber;

wherein contact ends of the plurality of comb teeth are spaced apart from each other to define yarn-passing gaps configured to allow continuous passage of chunky yarn through the working chamber;

wherein the plurality of comb teeth form a plurality of combing layers spaced apart from each other along a length direction of the working chamber;

wherein projected contours of adjacent combing layers on a first projection plane perpendicular to the central axis at least partially do not overlap; the projected contours of adjacent combing layers on the first projection plane are arranged in an offset manner;

wherein each of the plurality of comb teeth comprises a first inclined surface and a second inclined surface arranged opposite to each other; each of the first inclined surface and the second inclined surface is flat;

wherein the plurality of comb teeth are configured to gradually separate and loosen surface fibers of the chunky yarn during relative movement of the chunky yarn through the working chamber.

12. The chunky yarn fluffer tool according to claim 11, wherein a cross-sectional area of each of the plurality of comb teeth gradually decreases from the connecting end toward the contact end.

13. The chunky yarn fluffer tool according to claim 11, wherein the working chamber has a first end and a second end that are spaced apart from each other along a length direction of the chunky yarn fluffer tool, wherein the first inclined surface faces toward the first end and extends inclinedly from the inner wall of the working chamber towards the second end, and the second inclined surface faces toward the second end and extends inclinedly from the inner wall of the working chamber towards the first end.

14. The chunky yarn fluffer tool according to claim 13, wherein an inclination angle of the first inclined surface is equal to an inclination angle of the second inclined surface.

* * * * *